US006953110B2

(12) United States Patent
Santy et al.

(10) Patent No.: US 6,953,110 B2
(45) Date of Patent: Oct. 11, 2005

(54) THREE DIMENSIONAL POCKET CONSTRUCTION FOR A LUGGAGE CASE

(75) Inventors: Dirk Santy, Koekelare (BE); Clemens Van Himbeeck, Ronse (BE)

(73) Assignee: Samsonite Corporation, Denver, CO (US)

( * ) Notice: Subject to any disclaimer, the term of this patent is extended or adjusted under 35 U.S.C. 154(b) by 0 days.

(21) Appl. No.: 10/296,659

(22) PCT Filed: May 23, 2001

(86) PCT No.: PCT/US01/16554

§ 371 (c)(1),
(2), (4) Date: Jul. 14, 2003

(87) PCT Pub. No.: WO01/91597

PCT Pub. Date: Dec. 6, 2001

(65) Prior Publication Data

US 2004/0231942 A1 Nov. 25, 2004

Related U.S. Application Data

(60) Provisional application No. 60/207,736, filed on May 26, 2000.

(51) Int. Cl.[7] ..... A45C 13/00

(52) U.S. Cl. ..... 190/125; 190/124; 190/126; 190/127; 190/111

(58) Field of Search ..... 190/125, 124, 190/126, 127, 109, 111

(56) References Cited

U.S. PATENT DOCUMENTS

| | | | | | |
|---|---|---|---|---|---|
| 1,618,955 | A | * | 2/1927 | Gotisar | 190/114 |
| 3,410,376 | A | * | 11/1968 | Benzel | 190/110 |
| 4,307,765 | A | * | 12/1981 | Davis | 190/124 |
| 4,729,460 | A | * | 3/1988 | Kim | 190/109 |
| 5,105,919 | A | | 4/1992 | Bomes | |
| 5,497,919 | A | * | 3/1996 | Klinger | 224/416 |
| 5,547,052 | A | | 8/1996 | Latshaw | |
| 5,678,666 | A | | 10/1997 | Shyr | |
| 5,875,876 | A | | 3/1999 | Wang | |
| 6,000,509 | A | * | 12/1999 | Chisholm | 190/109 |
| 6,102,172 | A | * | 8/2000 | Dercole | 190/18 A |
| 6,161,665 | A | * | 12/2000 | Hoover | 190/106 |
| 6,213,266 | B1 | * | 4/2001 | Hollingsworth | 190/108 |

* cited by examiner

*Primary Examiner*—Tri M. Mai
(74) *Attorney, Agent, or Firm*—Gregory W. O'Connor

(57) ABSTRACT

A luggage case (10) includes a main packing door (20) that has defined two volume pockets. A volume pocket (26) extends across the top of the packing door and a second volume pocket (38) across the bottom and major portion of the packing door. Elongated panels such as inverted U-shaped panel (22), elongated panel (40), and a second elongated panel (30), all include a stiffening foam layer which, together with door panel (28) and rectangular panel (34), define an overall truncated pyramid shape on the main access door. A single textile divider panel (44) separates the first and second volume pockets a minimum amount of material or sewing being required.

5 Claims, 6 Drawing Sheets

THREE DIMENSIONAL POCKET CONSTRUCTION FOR A LUGGAGE CASE

This application is a 371 of PCT/US01/16554 May 23, 2001, which claims benefit of 60/207,736 May 26, 2000.

BACKGROUND OF THE INVENTION

The subject invention relates to luggage cases generally, especially so-called upright luggage cases having mostly textile front panels, with separately accessible volume pockets mounted on the main access door of the main packing compartment. More particularly, the subject invention relates to a simple method for assembling such volume pockets, and the door on which they are arrayed, from known textile construction materials.

In the prior art type luggage case typified by FIGS. 1, 2 and 3, the overall luggage case is a generally 6-sided box shape with the main or front wall comprising a self-hinged door zippered to the front of the main packing compartment. The door includes at least two pockets, one above the other. Each of the volume pockets is assembled by a peripheral rail member sewn to the main zipper accessing door, with each rail having a pocket face of textile material stitched to the rail using an edge beading or the like. Further, zippered access may be had through the face of the pocket (as shown in the lower door of FIG. 1) or along an upper portion of the rail, such as that shown in the upper pocket of FIGS. 1 and 2. FIG. 2 shows a side view of the prior art system where each pocket rail has a substantially uniform depth dimension creating luggage pockets with a similar parallelopiped shape. The space between the upper and lower volume pockets comprises essentially two thicknesses of rail material with a narrow gap therebetween. Both the upper and lower volume pockets are defined at their outermost edges by the edge beading as set forth above. The back of the prior art luggage case is similar to that of the instant invention in that it includes an upwardly extendible handle assembly for wheeling the case on the fixed axis wheels shown at the lowermost corners of the case.

While such prior art cases present pockets with substantial packing volume, the sewing and cutting operations to create these separately defined pockets are fairly complex. The present invention teaches a simple construction technique that defines two visually and functionally distinct volume pockets on the main packing door of an upright case that are simple to construct yet are easy to understand and operate. Accordingly, the disclosed luggage case improvement comprises a first volume pocket carried by the main access door of an upright luggage case, this first volume pocket being constructed of a generally inverted U-shaped textile panel attached along its outermost edges across the top edge of the access door and down a substantial portion of the access door on either side of the top edge, and a door panel for this first pocket which is affixed in the bite of this U-shaped panel to form a three dimensional shape of the first pocket. This first pocket is accessible from the outside of the case. Below this first pocket is a second pocket extending the full width dimension of the access door and affixed at its upper edge to the lower edge of the first pocket. Thus, the second pocket forms, together with this first pocket, upstanding sides which extend around the entire periphery of the access door and define a packing volume on the main access door.

DETAILED DESCRIPTION OF THE PREFERRED EMBODIMENTS

Figure 4:
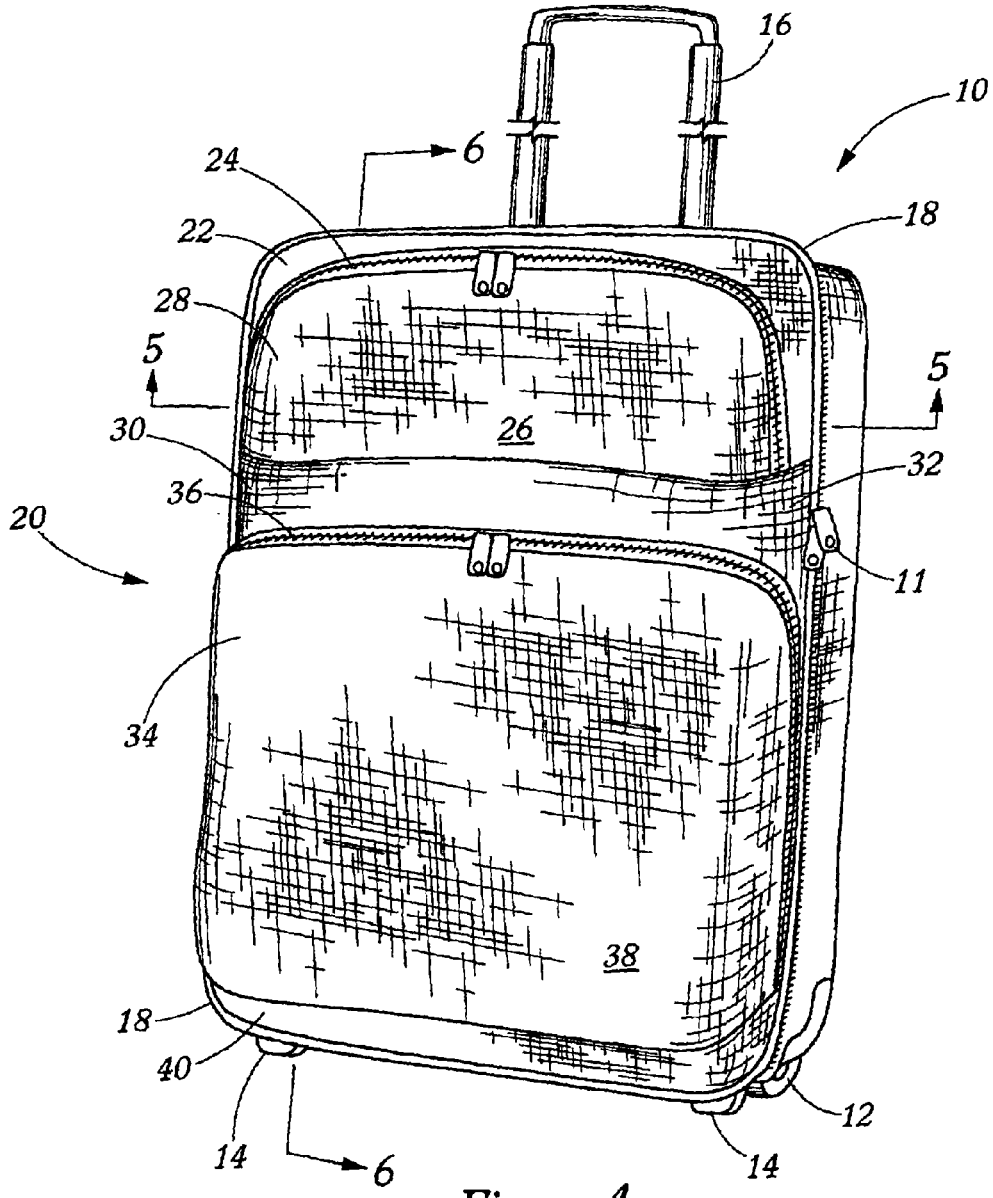
FIG. 4 is a perspective view of a case with the inventive pocket and main packing door construction.

In FIG. 4, the distinctive aesthetics and shape of a luggage case 10 is shown, resulting from the inventive construction as will be detailed. Note the inventive case has an overall upright luggage construction, including a pair of wheels 12 (one shown), glides 14 to steady the case in the upright position while resting on the wheels, and a pull up handle 16 for pulling the case on the wheels 12 mounted at the back lower edge of the case. The case also includes edge beading 18 that continues substantially around the entire vertical periphery of the case between the main access door 20 and the rest of the case. The main access door 20 is self-hinged to the remaining portion of the case and releasably closed by zipper 11 around 3 sides, and has a distinctive configuration and overall shape. The portion positioned forward in FIG. 4 from the edge beading 18 not only looks distinctive but is constructed in a unique fashion. Starting from the top, the main access door 20 includes a first volume pocket 26 comprised of an inverted U-shaped textile panel 22 that extends from about one-third to one-quarter of the overall height dimension of the main access door 20 down each side of the door and across the top of the door between the upper portion of the edge 3 beading 18 and a zipper 24. This zipper 24 selectively opens into the first volume pocket 26 formed on, protruding from, and carried by the main access door 20. The first pocket has a door panel 28 which consists of an elongated rectangular textile panel which is rounded at its upper corners and positioned within the bite of the inverted U-shaped textile panel 22. Below this first door is a preferably single second elongated panel 30 that extends across the full width of the case from one side to the other of the peripheral edge beading 18. This second elongated panel 30 has a relatively narrow center portion that smoothly curves slightly outwardly to define relatively wide portions 32 at the extreme ends thereof. Immediately below this elongated panel is a large rectangular textile panel 34 that forms the front of the second volume pocket 38, as well as the zippered rectangular panel 34 for access into the second volume pocket 38. Between the large rectangular textile panel 34 and the second elongated panel 30 is a second zippered opening 36 into the second volume pocket 38 carried by the main access door 20. Preferably, this rectangular textile panel again extends all the way across the access door 20 from one portion of the edge beading 18 to the other portion of the edge beading 18. Unlike the elongated panel 28, however, the rectangular textile panel 34 narrows or tapers along both its upper and lower edges substantially near each edge. A final or lower U-shaped elongated panel 40 closes off the bottom portion of the access door. This lower U-shaped panel is fastened along its lower edge to the lower portion of the edge beading 18 with known sewing techniques as will be detailed. The lower U-shaped elongated panel 40 has an overall upright U-shape with the ends of the U tapering at the edge beading 18.

All of the panels, namely the inverted U-shaped panel 22, the door panel 28, the second elongated panel 30, the rectangular textile panel 34, and the second U-shaped elongated panel 40, are so shaped to form a three dimensional truncated pyramid shape with smoothly tapering edges around the periphery of the main access door, i.e., along each rectangular edge paralleling the edge beading 18 and an overall slightly bulbous front face. The second elongated panel 30 is seen to define the relatively smaller elongated first volume pocket 26 a substantial distance from the second volume pocket 38 which is substantially defined by the rectangular textile panel. In fact, as will be seen from FIG. 5, the packing volumes defined by these two volume pockets are not separated, but share a single textile wall called a divider panel 44. This is a major advantage over prior art constructions. Distinctive aspects of this construction include the complete absence of edge beading running vertical and parallel to the vertical portions of the edge beading 18. This is because each of the textile panels are attached to one another and shaped to form the overall three dimensional form of a truncated pyramid set forth above. This is especially facilitated by the shape of the inverted U-shaped panel 22 on the upper end and the second elongated panel 30, the second U-shaped elongated panel 40, and rectangular panel 34 there-between at the other end of main access door 20 which serve to not only define upwardly standing but slightly tapered upper and lower walls respectively of the overall access panel construction, but also at least partially define the vertical upstanding side walls of the overall construction. Cross section 5 shows the typical shape of the panel 28, as well as panels 30 and 34. Note how the main panels 28 (and thus 34) are forced to bow outward, especially near the lateral sides thereof. This is because of the stiffness of the material of panels 28 and 34, combined with the dimensional constraint of back panel 49 of main access door 20. The result is a bulbous appearance of first volume pocket 26 and second volume pocket 38. This bowing, together with the vertically extending portions of inverted U-shaped panel 22, create a tapering, sculptured pocket with a substantial volume created by the upstanding portions of inverted U-shaped panel 22 and the bowed portion of panel 28. Again, while this is shown with regard to the first volume pocket 26 and the panels which create that pocket 26, the same phenomenon occurs in virtually all portions of the main access door 20. For example, rectangular panel 34 bends all the way around to beading 18 on both sides of the main access door 20, but this bowing or bending is facilitated by the tapering shape of second elongated panel 30 and elongated panel 40 as well as the stiffening members that make up those panels, as will be detailed below.

Figure 5:
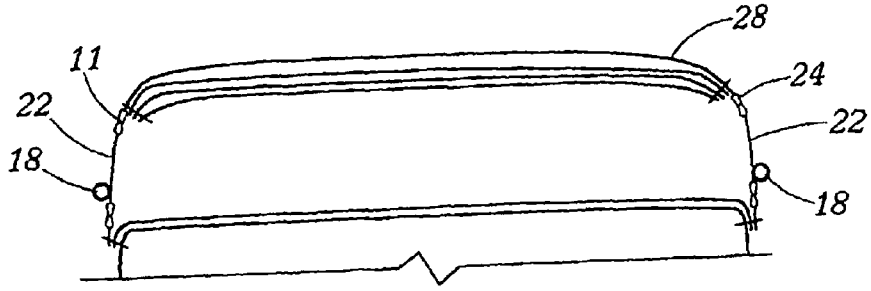
FIG. 5 is a cross section through line 5—5 of FIG. 4.
Figure 6:
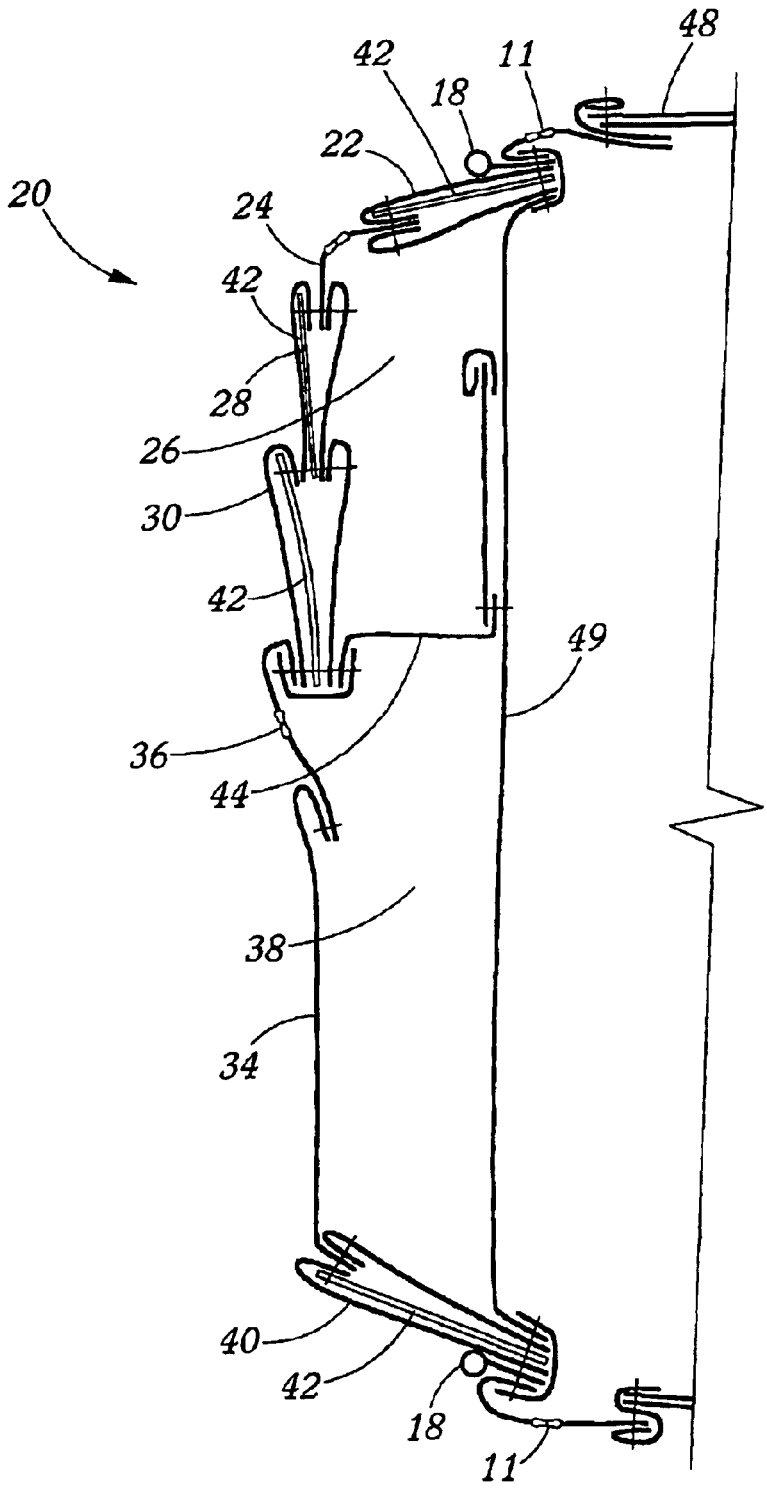
FIG. 6 is a cross-section through line 6—6 of FIG. 4.
Figure 7:
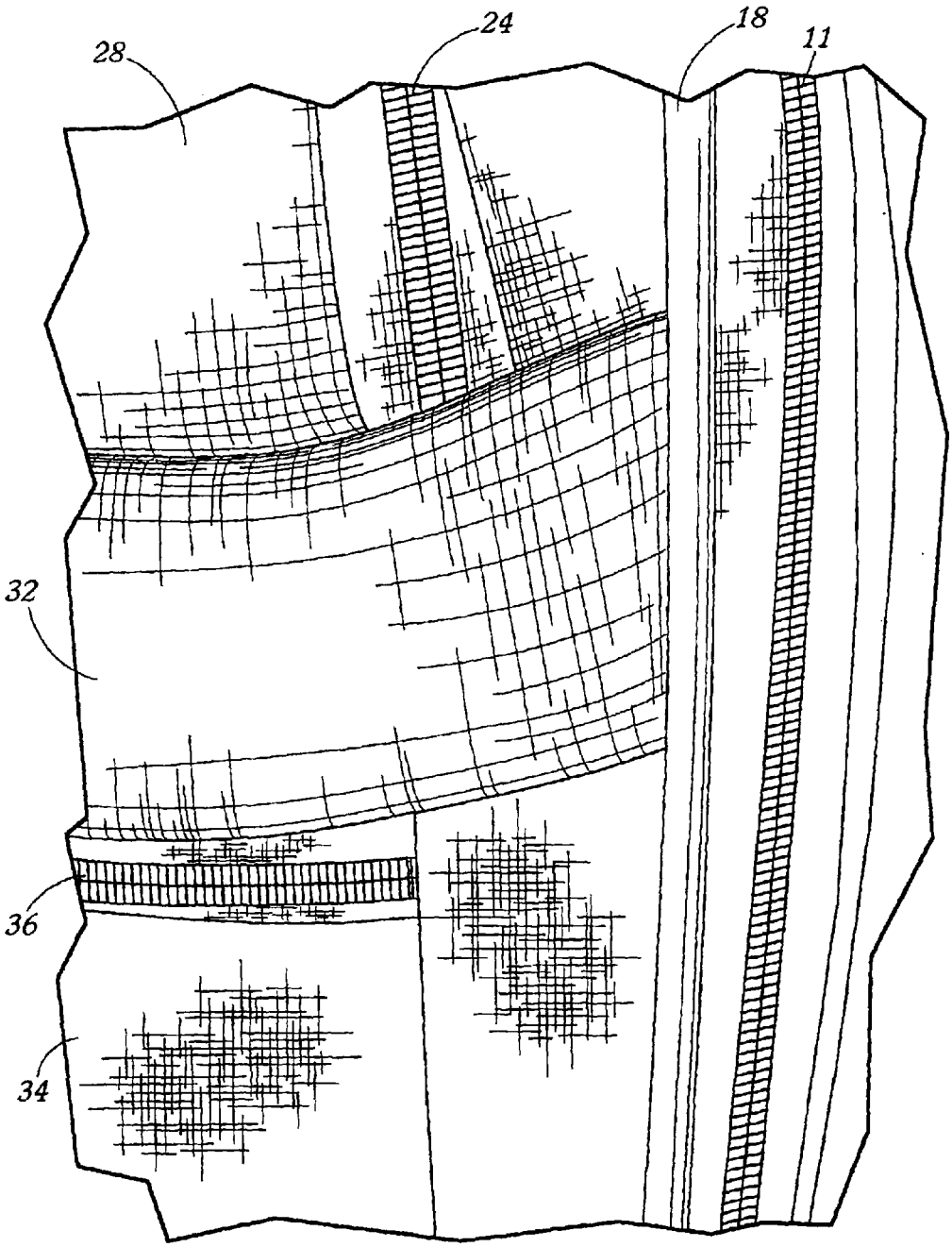
FIG. 7 is a closeup of a part of the pocket construction of FIG. 4.

Note in both FIGS. 5 and 6, stitch lines are schematically shown in these cross sections as short lines cutting across the various overlapping panel edges. Thus, the end portions of the elongated panel 30 and the corresponding end portions of the rectangular textile panel 34 also contribute to upstanding walls along the left and right vertical portions of the main access door 20 and thus have greater dimensions than the corresponding dimensions of the back panel 49.

Figure 1:
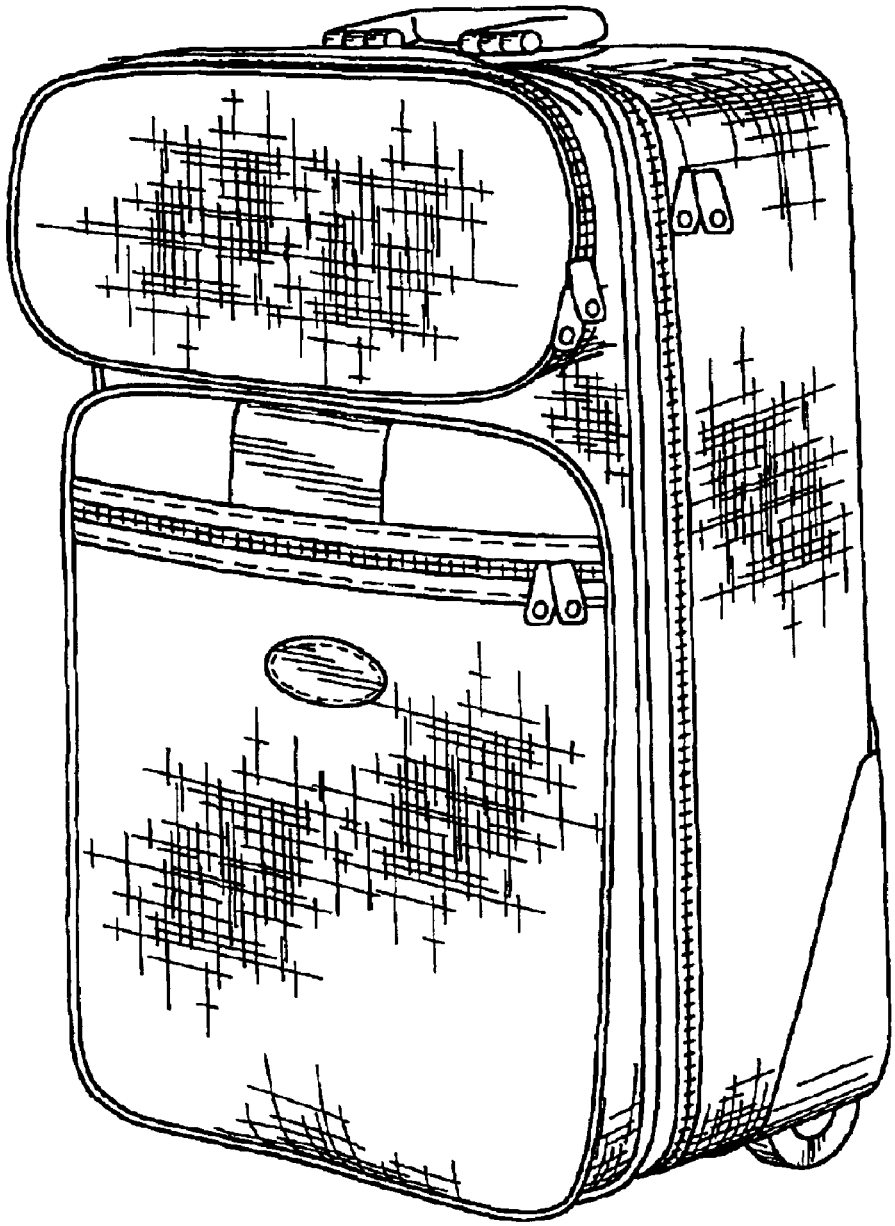
Figure 1 (Prior Art)
FIG. 1 shows a prior art luggage case or upright case with a pair of protruding pockets.
Figure 2:
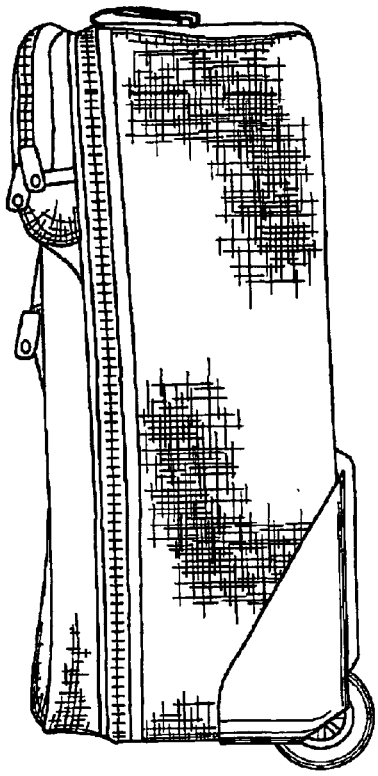
Figure 2 (Prior Art)
FIG. 2 is a side view of the prior art pocket construction.
Figure 3:
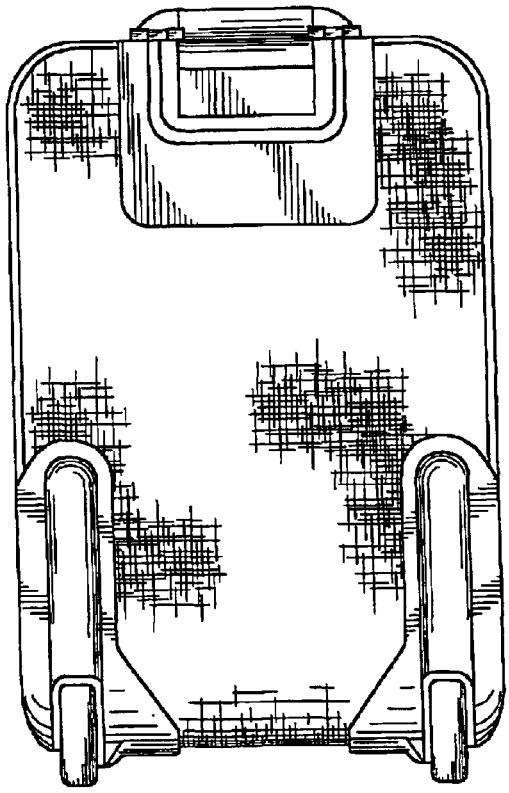
Figure 3 (Prior Art)
FIG. 3 is a back view of the prior art case.

Referring particularly to FIG. 6 as mentioned previously, one surprising aspect of this cross section is that, unlike the prior art case shown in FIGS. 1, 2 and 3, there is only a single divider wall or divider panel 44 between the upper first volume pocket 26 and the lower second volume pocket 38. In this way, all volume occupied by the case can accommodate the property of the traveler with almost no wasted space between the strongly visually separated volume pockets. In addition, a minimum amount of textile material need be used to construct the voluminous upper and lower pockets, yet define and separate these pockets functionally.

Note in particular that the main access zipper 11 is sewn using conventional sewing techniques between the main rail 48 of the luggage case and the access door construction, as is herein detailed. The inverted U-shaped panel 22 is constructed of an inner and an outer textile layer with a thin, flexible polymer foam or polymer sheet material 42 of known composition trapped between these two textile panels. This laminated construction of the inverted U-shaped panel 22 also characterizes the door panel 28, the second elongated panel 30, and the elongated panel 40. The foam construction gives these panels a soft, yet structural, characteristic to let these elongated, relatively extensive panels 28 and 34 of textile fulfill the many functions normally carried by separate rail and edge beading construction. In contrast, the rectangular textile panel 34, behind which is formed the second larger volume pocket 38, is itself not necessarily stiffened by a polymer foam 42 panel. This is in order to reduce costs, but also to permit this panel to flex easily when opened and after being packed. Besides, it has been found that the thus properly structurally enhanced elongated panel 40 and second elongated panel 30 work together to shape the rectangular textile panel 34 appropriately for a good showing in the luggage shop.

Between the first pocket and second pocket is a single textile divider panel 44 sewn to the back panel 49 of the access door and along the seam forming the upper edge of the access zipper 36 into the second volume pocket 38. The U-shaped zipper 24 into the first pocket opens readily to give access all the way down to this divider panel 44. This is especially important when this pocket tends to be the favored storing space for those last minute items such as umbrella, magazine, or the like, that must be retrieved rapidly. In contrast, the second pocket is much deeper than the first pocket, usually appropriate for a single item such as a trench coat or a rain coat, sweater or the like. Thus, this pocket can be much deeper and accessed by a less accommodating zipper opening 36 as shown.

Figure 8:
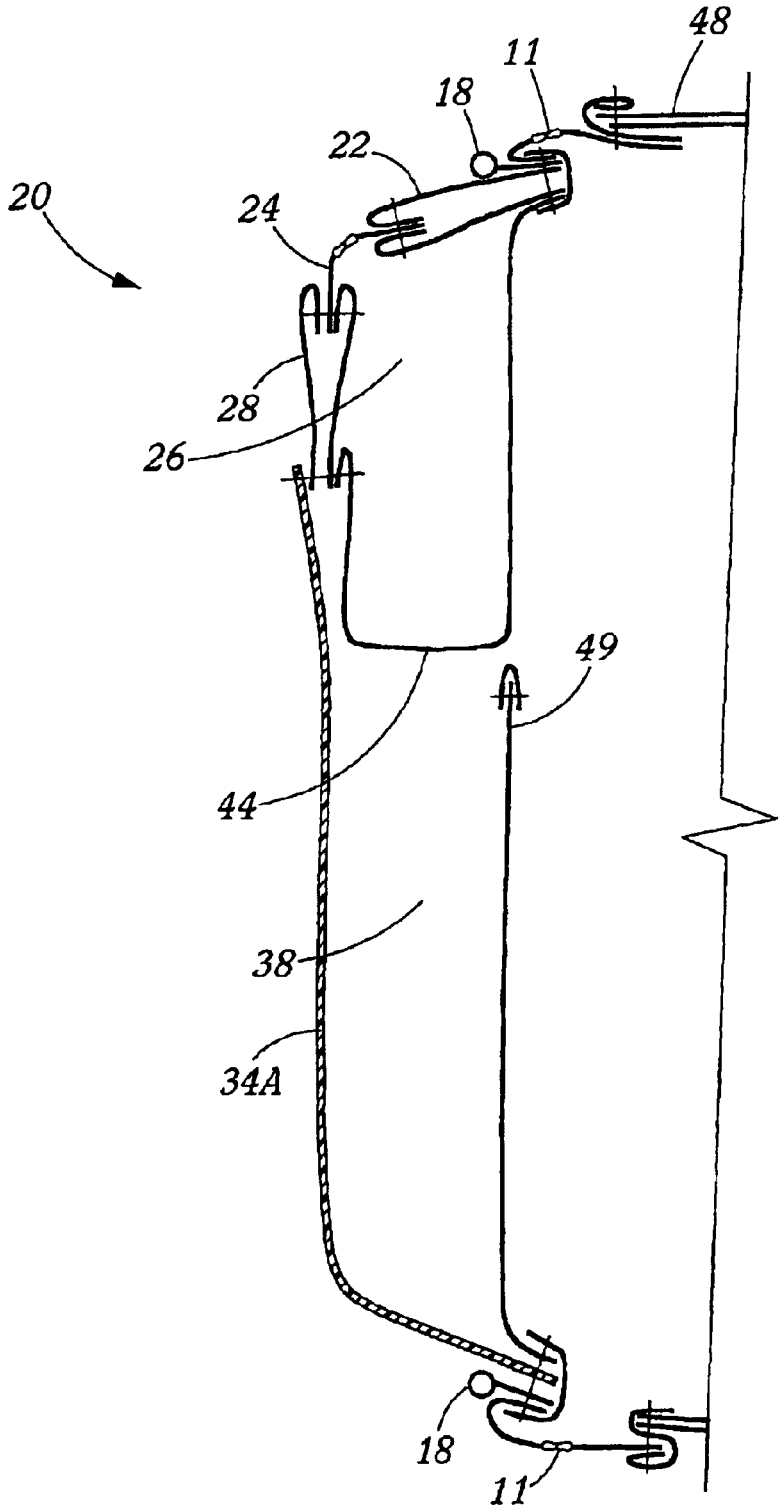
FIG. 8 is a cross section view similar to FIG. 6 showing an alternative pocket construction.

Alternatively, lower pocket 38 could be defined by a stiff laminated textile panel 34A (FIG. 8), which is shaped to take the place of the three panels 34, 30 and 40. Here, access to the second pocket 38 is had through back panel 49 on the back side of the main access door 20.

What is claimed is:

1. A luggage case comprising a handle, a main packing compartment, and a main access door to the packing compartment, the improvement comprising at least a first volume pocket carried by the main access door, said first volume pocket being constructed of a generally inverted U-shaped textile panel attached along its major edges across a top edge of the main access door and down a substantial distance on either side of the main access door from the top edge, a door panel for the first volume pocket affixed in a bite of the inverted U-shaped panel to form a three dimensional shape of the first volume pocket accessible from the outside of the case, a second volume pocket extending a full width dimension of the main access door and fixedly attached along its upper edge to a lower edge of the first volume pocket, the second volume pocket forming, together with the first volume pocket, upstanding sides extending from the periphery of the main access door and defining a packing volume on the main access door, wherein the inverted U-shaped panel includes a layer of polymer foam for stiffening the inverted U-shaped panel and wherein the door panel and the elongated panel also include a layer of stiffening foam polymer.

2. A luggage case comprising a handle, a main packing compartment, and a main access door to the packing compartment, the improvement comprising: said main access door having two sides each disposed at an angle rearward of an exterior surface of said main access door at least a first volume pocket, that has an appearance of fullness or bulk whether the first volume pocket is empty or full, carried by the main access door, said first volume pocket being constructed of a generally inverted U-shaped textile panel, said inverted U-shaped panel having a smooth, continuous, uninterrupted construction, said inverted U-shaped panel attached along its major edges across a top edge including said sides of the main access door and down a substantial distance on said sides of the main access door from the top edge, a door panel for the first volume pocket affixed in a bite of the inverted U-shaped panel to form a three dimensional shape of the first pocket accessible from the outside of the case, a second volume pocket, having an appearance of fullness or bulk whether said second volume pocket is empty or full, extending a full width dimension of the main access door and fixedly attached along its upper edge to a lower edge of the first volume pocket, wherein the second volume pocket is defined, at least in part, by a rectangular textile panel affixed at the lower edge of the first volume pocket, said rectangular textile panel having a smooth, continuous, uninterrupted construction and extending the full width of the main access door, an elongated panel standing upright from the main access door and fastened to the lower edge of the rectangular textile panel, and fastened along an upper edge thereof to a lower edge of the rectangular textile panel.

3. A luggage case as set forth in claim 2 wherein a zipper connects the door panel to the bite of the inverted U-shaped panel, the zipper permitting access to the first volume pocket defined in part by the door panel and the inverted U-shaped panel.

4. A luggage case as set forth in claim 2 further comprising a pair of wheels affixed to a lower portion thereof.

5. A luggage case as set forth in claim 2 further comprising a main access door back panel extending generally in a plane and fastened to a periphery of the main access door, a divider panel extending from this back panel to an intersection at a lower edge of the first volume pocket, whereby a first volume pocket and a second volume pocket volume is defined between the back panel and the door panel, the rectangular textile panel, and at least portions of the inverted U-shaped panel and the elongated panel.

* * * * *